US008677967B2

(12) United States Patent
Ito et al.

(10) Patent No.: US 8,677,967 B2
(45) Date of Patent: Mar. 25, 2014

(54) INTAKE MANIFOLD HAVING NEGATIVE PRESSURE RELIEF

(75) Inventors: Atsushi Ito, Anjo (JP); Fumihiro Shinkai, Chiryu (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/575,160

(22) PCT Filed: Dec. 21, 2010

(86) PCT No.: PCT/JP2010/073040

§ 371 (c)(1), (2), (4) Date: Jul. 25, 2012

(87) PCT Pub. No.: WO2011/092972

PCT Pub. Date: Aug. 4, 2011

(65) Prior Publication Data

US 2012/0291741 A1 Nov. 22, 2012

(30) Foreign Application Priority Data

Jan. 28, 2010 (JP) ..... 2010-017407

(51) Int. Cl.
*F02M 35/104* (2006.01)

(52) U.S. Cl.
USPC ..... 123/184.47; 123/184.53; 123/184.54

(58) Field of Classification Search
USPC ..... 123/184.47, 184.53, 184.54, 184.21
See application file for complete search history.

(56) References Cited

U.S. PATENT DOCUMENTS 6,438,945 B1 8/2002 Takagi et al.
6,644,260 B2 * 11/2003 Tsukii et al. ..... 123/184.42
7,011,064 B2 * 3/2006 Kito et al. ..... 123/184.42

(Continued)

FOREIGN PATENT DOCUMENTS

JP 11-229928 A 8/1999
JP 2000-120470 A 4/2000

(Continued)

OTHER PUBLICATIONS

International Search Report (PCT/ISA/210) issued on Apr. 5, 2011, by the Japanese Patent Office as the International Searching Authority for International Application No. PCT/JP2010/073040.

(Continued)

*Primary Examiner* — Noah Kamen
*Assistant Examiner* — Grant Moubry
(74) *Attorney, Agent, or Firm* — Buchanan Ingersoll & Rooney PC

(57) ABSTRACT

Disclosed is an intake manifold having a surge tank connected to an air intake passage for air to be supplied to an internal combustion engine. The intake manifold includes a gas introduction section communicated to the air intake passage or the surge tank for introducing gas containing fuel component to the surge tank and a negative pressure feed passage communicated to a portion of the air intake passage or the surge tank which portion is upstream of the gas introduction section in the movement direction of the air and configured to feed a negative pressure inside the surge tank to the outside. The negative pressure feed passage is connected to the air intake passage or the surge tank via an expansion chamber having a larger cross-sectional area than the cross-sectional area of the negative pressure feed passage.

5 Claims, 3 Drawing Sheets

(56) References Cited

U.S. PATENT DOCUMENTS

| | | | | |
|---|---|---|---|---|
| 7,357,110 | B2 | 4/2008 | Hashimoto et al. | |
| 7,451,732 | B1 * | 11/2008 | Vichinsky et al. | 123/184.47 |
| 8,095,289 | B2 * | 1/2012 | Suzuki et al. | 701/70 |
| 8,186,323 | B2 * | 5/2012 | Akimoto et al. | 123/184.53 |
| 8,511,289 | B2 * | 8/2013 | Tanikawa et al. | 123/568.17 |
| 2006/0065225 | A1 * | 3/2006 | Shimatsu | 123/184.55 |

FOREIGN PATENT DOCUMENTS

| | | | |
|---|---|---|---|
| JP | 2002-161774 | A | 6/2002 |
| JP | 2003-254178 | A | 9/2003 |
| JP | 2005-048736 | A | 2/2005 |
| JP | 2007-040142 | A | 2/2007 |

OTHER PUBLICATIONS

Written Opinion (PCT/ISA/237) issued on Apr. 5, 2011, by the Japanese Patent Office as the International Searching Authority for International Application No. PCT/JP2010/073040.

Notification of Transmittal of Translation of the International Preliminary Report on Patentability (Chapter I or Chapter II)(PCT/IB/338), International Preliminary Report on Patentability (Form PCT/IB/373) and the Written Opinion of the International Searching Authority(Translation)(Form PCT/ISA/237) issued on Sep. 27, 2012, in corresponding International Application No. PCT/JP2010/073040. (7 pages).

* cited by examiner

INTAKE MANIFOLD HAVING NEGATIVE PRESSURE RELIEF

TECHNICAL FIELD

The present invention relates to an intake manifold for use in an internal combustion engine.

BACKGROUND ART

Some conventional intake manifolds include a gas introduction section for introducing into a surge tank a gas containing mist-like oil component or water vapor such as blowby gas in a crankcase, a PCV gas from a canister, an EGR gas (exhaust gas recirculation gas), etc. and include also a negative pressure feed passage for feeding an intake negative pressure inside the surge tank to the outside (e.g. a brake booster, etc.). With such intake manifolds, there is a concern that fuel component and water contained in the gas introduced from the gas introduction section may inadvertently enter the negative pressure feed passage and freeze therein to block a negative pressure feed port.

As an intake manifold for solving the above concern, there is disclosed a technique wherein a concentration port is provided to communicate with a main flow passage for air and the concentration port includes a gas introduction section (referred to as "a gas introduction port" in the document) for introducing a gas containing mist-like fluid or vapor and a negative pressure feed passage (referred to as "a negative pressure introduction port" in the document) for introducing a negative pressure, and a partition wall portion is provided between the gas introduction section and an opening of the negative pressure feed passage (see Patent Document 1).

Also disclosed is a technique wherein there is provided a raised portion at an appropriate position in an inner face of a wall portion constituting the surge tank, the raised portion being raised therefrom and forming a step relative thereto and there is provided also a gas introduction section (referred to as "a gas introduction hole" in the document) provided at an appropriate position of the wall portion inner face other than the raised portion for introducing a water vapor containing gas, a negative pressure feed passage (referred to as "an intake negative pressure outlet hole" in the document) for taking the intake negative pressure inside the surge tank to the outside is connected to the raised portion and in the raised face of the raised portion and at an area thereof located upwardly of an opening of the negative pressure feed passage, there is provided a guide groove for receiving water dropped along the wall portion inner face upwardly of the raised portion and guiding the received water to a position away from the negative pressure feed passage (see e.g. Patent Document 2).

CITATION LIST

Patent Literature

Patent Document 1: Japanese Unexamined Patent Application Publication No. 2003-254178

Patent Document 2: Japanese Unexamined Patent Application Publication No. 2007-40142

SUMMARY OF INVENTION

Technical Problem

Incidentally, inside a surge tank of an intake manifold, there is generated an entraining flow for distributing an amount of mixture gas (air, PCV gas and EGR gas) uniformly to a plurality of cylinders connected to the engine.

In the case of the intake manifold disclosed in Patent Document 1, though being separated from each other by a partition wall therebetween, the gas introduction section and the opening of the negative pressure feed passage are disposed adjacent each other. For this reason, due to the entraining flow generated inside the surge tank, the gas fed from the gas introduction section tends to enter the negative pressure feed passage. Namely, the gas may enter the negative pressure feed passage as being carried by the entraining flow, so that there is the risk that the negative pressure feed passage may become blocked as the mist-like fluid or vapor contained in the gas is coagulated therein.

Similarly, with the intake manifold disclosed in Patent Document 2 also, although there is provided the guide groove at the raised portion for restricting entrance of water droplets to the negative pressure feed passage, the involving flow inside the surge tank may cause diffusion of water droplets which flows along the guide groove while circumventing the negative pressure feed passage. Therefore, the diffused water droplets tend to enter the negative pressure feed passage as being carried by the entraining flow, so there is again the risk of blocking of the negative pressure feed passage by the coagulation therein.

The present invention has been made in view of the above-described problem and its object is to restrict entrance to the negative pressure feed passage of fuel component and/or water contained in a gas introduced from the gas introduction section, thereby to restrict occurrence of blocking of the negative pressure feed passage.

Solution to Problem

According to the first characterizing feature of an intake manifold relating to the present invention, in an intake manifold having a surge tank connected to an air intake passage for air to be supplied to an internal combustion engine, the intake manifold comprises:

a gas introduction section communicated to the air intake passage or the surge tank for introducing gas containing fuel component to the surge tank; and a negative pressure feed passage communicated to a portion of the air intake passage or the surge tank which portion is upstream of the gas introduction section in the movement direction of the air and configured to feed a negative pressure inside the surge tank to the outside, the negative pressure feed passage being connected to the air intake passage or the surge tank via an expansion chamber having a larger cross-sectional area than the cross-sectional area of the negative pressure feed passage.

With the above-described characterizing arrangement, since the negative pressure feed passage is provided more upstream in the movement direction of the air than the gas introduction section, it is possible to restrict inadvertent entrance of the gas introduced from the gas introduction section into the negative pressure feed passage under the influence from the entraining flow inside the surge tank. That is, blocking of the negative pressure feed passage by fuel component or water contained in the gas as well as clog-up of the negative pressure feed passage due to coagulation thereof can be effectively restricted, so that the negative pressure can be fed appropriately to the outside. As the negative pressure feed passage can be disposed more upstream in the air movement direction than the gas introduction section, the disposing position of the negative pressure feed passage may vary as desired in accordance with an arranging space available in each particular vehicle. Hence, there is provided greater freedom in designing.

Further, since the cross-sectional area of the expansion chamber is greater than the cross-sectional area of the negative pressure feed passage, the suction force by the negative pressure prevailing at the surge tank side inlet of the expansion chamber is smaller than the suction force by the negative pressure in the negative pressure feed passage. Accordingly, in comparison with an arrangement having no such expansion chamber, the fuel component or water contained in the gas will enter the negative pressure feed passage less likely.

Moreover, as the negative pressure feed passage is substantively extended by the expansion chamber having a large cross-sectional area, even if fuel component or water may enter the expansion chamber, the component or water will adhere to the inner wall surface of the expansion chamber, so that entrance of the fuel component or water to the negative pressure feed passage may be effectively restricted. Consequently, blocking of the negative pressure feed passage by the fuel component or water contained in the gas as well as clog-up of the negative pressure feed passage due to coagulation thereof can be restricted even more effectively.

In the above, the language "the outside" refers to e.g. a brake booster, etc., to which the negative pressure inside the surge tank is to be applied.

According the second characterizing feature of an intake manifold relating to the present invention, the expansion chamber includes a first opening communicated to the negative pressure feed passage and a second opening communicated to at least one of the air intake passage and the surge tank, the second opening being provided with an opening area greater than that of the first opening.

For instance, if there were employed an expansion chamber in which the first opening has a larger opening area than the second opening, due to the smaller opening area of the second opening, there would tend to occur blocking due to adhesion of the fuel component or water contained in the gas at the second opening, thus tending to invite coagulation due to clog-up of the negative pressure feed passage.

On the other hand, with the above-described characterizing arrangement, since the second opening has a greater opening area than the first opening, the blocking of the second opening with the fuel component and water contained in the gas and the clog-up of the second opening due to the coagulation thereof will occur less likely. Also, as the first opening is separated from the gas introduction section via the expansion chamber, at the first opening too, the blocking with the fuel component or water contained in the gas or the clog-up of the first opening due to coagulation thereof will be effectively restricted. Consequently, blocking of the negative pressure feed passage with the fuel component or water contained in the gas or the clog-up of the negative pressure feed passage due to coagulation thereof will be effectively restricted, so that the negative pressure can be fed appropriately to the outside.

According the third characterizing feature of an intake manifold relating to the present invention, the expansion chamber includes a first piece having the first opening and formed integral with the negative pressure feed passage and a second piece having the second opening.

With the above-described characterizing arrangement, the expansion chamber is comprised of the combination of the first piece and the second piece and can be mounted in the intake manifold with a simple arrangement. That is, the expansion chamber can readily a form negative pressure feeding flow path to be fed from the negative pressure feed passage, through assembling the first piece and the second piece together.

Also, since the negative pressure feed passage is included in the first piece, compared with a case of constituting the negative pressure feed passage from the first piece and the second piece, the welding area between the first piece and the second piece can be small and at the same time, no welding failure will occur in the negative pressure feed passage. If the extending direction of the negative pressure feed passage is varied according to each particular vehicle, a negative pressure feeding flow path communicated to the negative pressure feed passage can be made shorter, thereby to form the intake manifold compact. Further, since there is no need to change the shape of the second piece for each particular vehicle, the same second piece can be used, irrespectively of the type of the vehicle.

With this characterizing arrangement, if e.g. the first piece has a shape whose width becomes narrower from its end bordering with the second piece toward the first opening and this first piece is formed by injection molding, the first piece can be easily removed from the mold.

According to the fourth characterizing feature of the intake manifold relating to the present invention, in the second opening, its opening size in the direction perpendicular to the air movement direction is set shorter than the opening size in the direction along the air movement direction.

When air to be fed to the internal combustion engine passes through the second opening, this air will move in a roundabout path to enter the expansion chamber and a vortex flow occurs at the edge portion of the second opening on the upstream side in the air movement direction and this vortex flow generates a gas flowing noise.

According to the above characterizing arrangement, in the second opening, the opening size in the direction perpendicular to the air movement direction is shorter than the opening size in the air movement direction. Namely, since the length of the edge portion of the second opening on the upstream side in the air movement direction which is the cause for the gas flowing noise is made shorter, the roundabout movement of the air into the expansion chamber is restricted. As a result, there occurs less vortex flow at the edge portion of the second opening on the upstream side in the air movement direction, whereby generation of gas flowing noise can be effectively restricted.

According to the fifth characterizing feature of the intake manifold relating to the present invention, the second opening has a shape whose longitudinal direction is the direction of its extension in the air movement direction and whose width direction is the direction of its extension in the direction perpendicular to the air movement direction, and the length of the edge portion of the second opening in the width direction is shorter on the upstream side in the air movement direction than on the downstream side in the air movement direction.

With the above described characterizing arrangement, the length of the edge portion of the second opening in the width direction is shorter on the upstream side than on the downstream side in the air movement direction. Therefore, if the sum of the lengths of the edge portion of the second opening in the width direction is considered fixed, the amount of vortex flow generation at the edge portion on the upstream side is smaller while maintaining constant the opening area of the second opening, in comparison with the arrangement of the length being longer on the upstream side than on the downstream side. Accordingly, the generation of gas flowing noise can be restricted even more effectively.

According to the sixth characterizing feature of the intake manifold relating to the present invention, of faces together constituting the expansion chamber, a face on the downstream side in the air movement direction is inclined toward the upstream side in the air movement direction.

With the above-described characterizing arrangement wherein the face on the downstream side in the air movement direction of those faces constituting the expansion chamber is inclined toward the upstream side in the air movement direction, when the negative pressure inside the surge tank is to be fed to the outside, the gas flow generated in association with this negative pressure feeding will be guided by this face to be combined smoothly with a flow of air flowing through the air intake passage. Therefore, a turbulent flow will hardly be generated inside the expansion chamber. Consequently, the possibility of the fuel component and water being drawn into the expansion chamber is reduced, whereby the occurrence of clog-up of the negative pressure feed passage can be prevented even more reliably.

DESCRIPTION OF EMBODIMENTS

Next, embodiments of the present invention will be described with reference to the accompanying drawings.

First, the general construction will be explained with reference to FIG. 1 and FIG. 2. An intake manifold 1 according to the instant embodiment is made of a resin and composed of an upper piece 1*a*, a middle piece 1*b* and a lower piece 1*c*. The upper piece 1*a* includes a welding face 10*a* to be welded to the middle piece 1*b*. The middle piece 1*b* includes a welding face 10*b* and a welding face 10*c* which are to be welded to the upper piece 1*a* and the lower piece 1*c*, respectively. The lower piece 1*c* includes a welding face 1*d* to be welded to the middle piece 1*b*. As the respective welding faces 10*a* through 10*d* are welded by vibration, the intake manifold 1 having a surge tank 2 is formed.

To the surge tank 2, there are connected an upstream intake passage 21 for passing air from a throttle body (not shown) and a plurality of downstream intake passages 22 for passing mixture gas from the upstream intake passage 21 to an engine (not shown). Incidentally, the mixture gas contains, in addition to air, a PCV gas and an EGR gas to be described later. The manifold is designed such that a flow of the mixture gas may be generated as a vortex flow (this will be referred to as "the entraining flow" hereinafter) inside the surge tank 2 so as to distribute the mixture gas containing air, the PCV gas and the EGR gas to the respective downstream intake passages 22 uniformly and at a same concentration.

Figure 1:
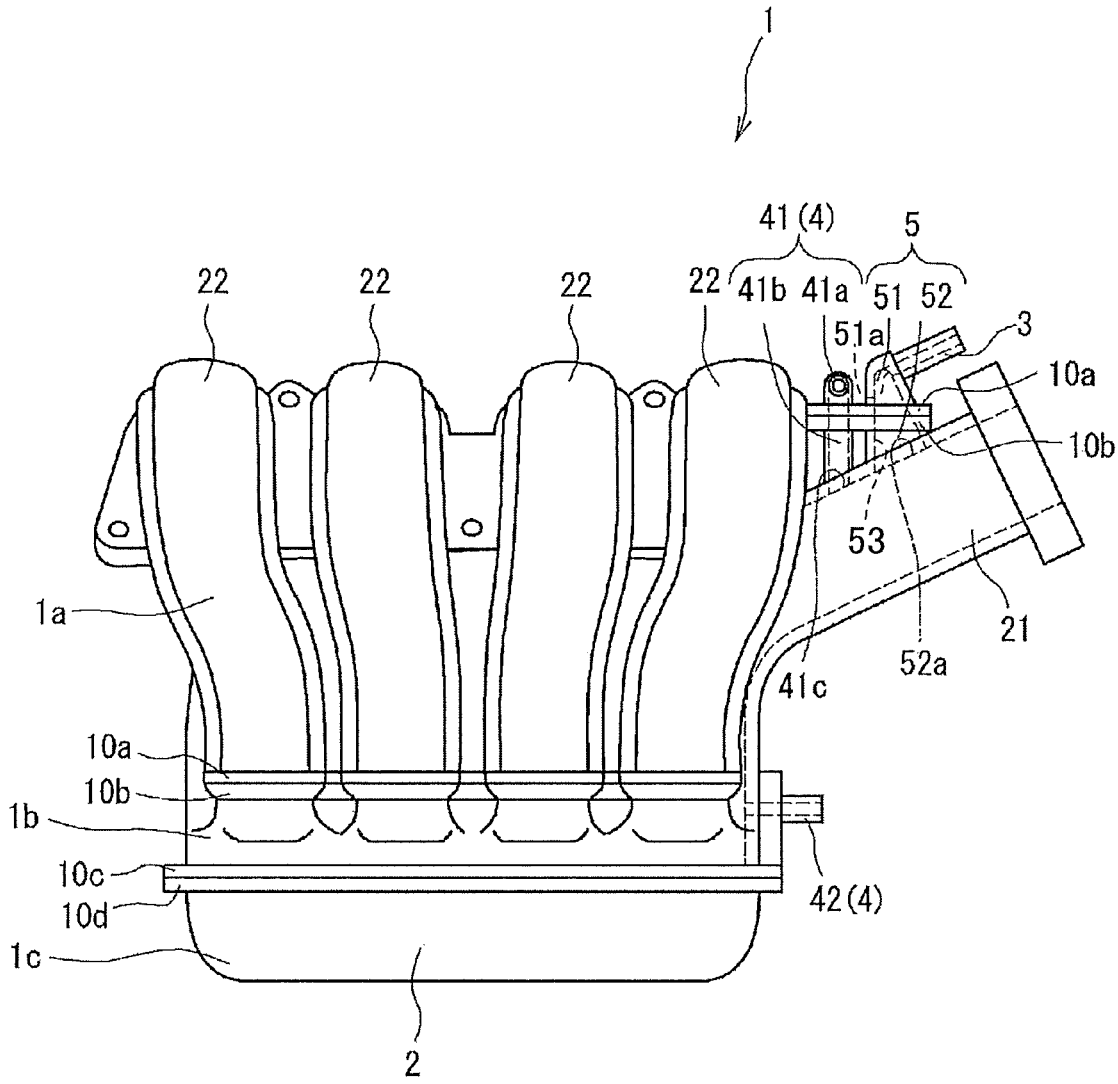
[FIG. 1] is a front view of an intake manifold according to an embodiment.
Figure 2:
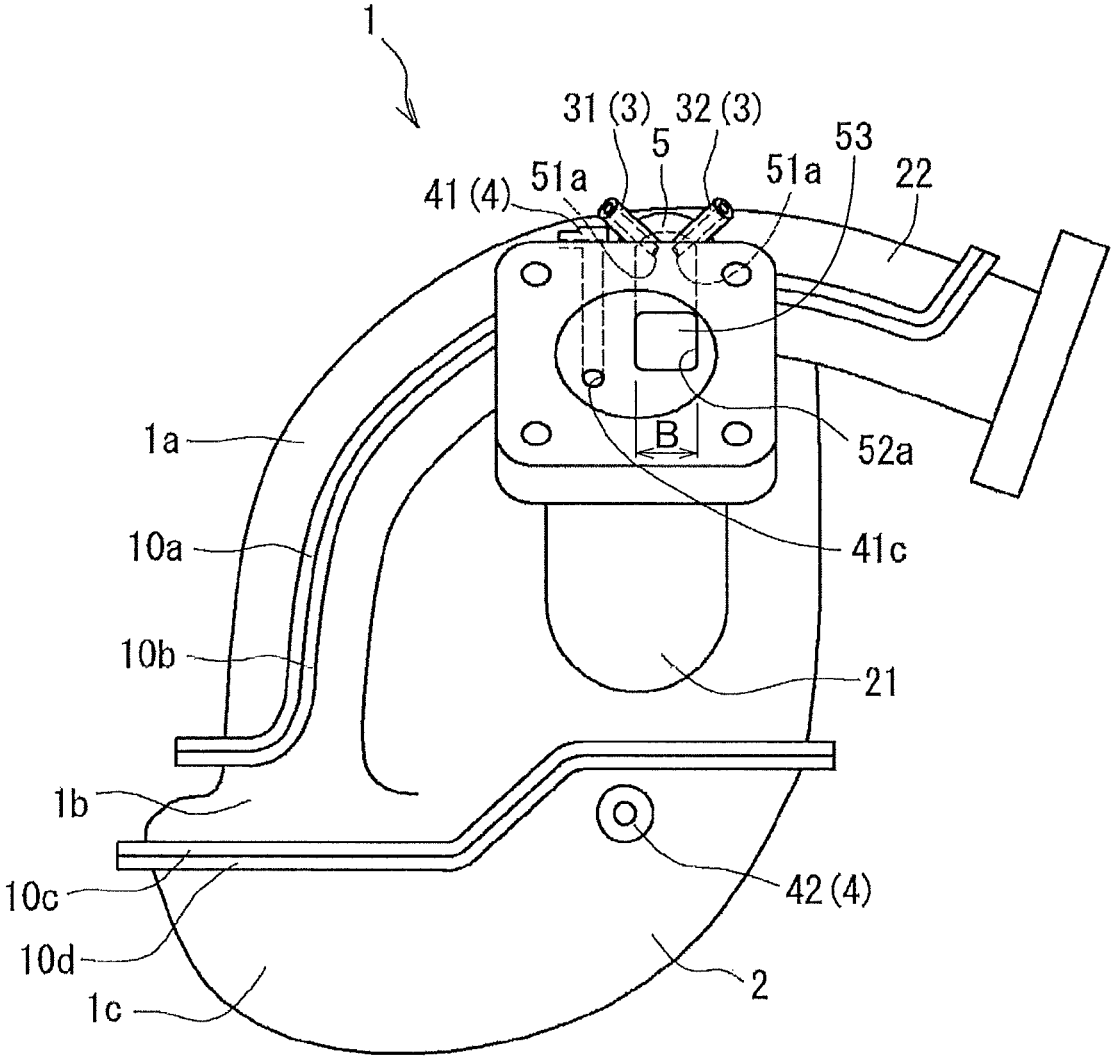
[FIG. 2] is a side view of the intake manifold according to the embodiment.

The intake manifold 1, as shown in FIG. 1 and FIG. 2, includes a vacuum pressure feed passage 3 ("a negative pressure feed passage") for feeding the vacuum pressure (negative pressure) inside the surge tank 2 to a vacuum pressure actuator (not shown) and to a brake booster (not shown) and a gas introduction section 4 for introducing the gas to the surge tank 2. The gas introduction section 4 includes a first gas introduction section 41 communicated to the upstream air intake passage 21 for introducing the PCV gas containing fuel component and liquid such as water therein and a second gas introduction section 42 communicated to the surge tank 2 for introducing the EGR gas containing fuel component and liquid such as water therein.

Meanwhile, there is the risk that the entraining flow generated inside the surge tank 2 causes the PCV gas and the EGR gas to inadvertently enter the vacuum pressure feed passage 3 thereby to prevent the vacuum pressure from being fed appropriately to the vacuum pressure actuator or the like. In order to avoid this risk, the vacuum pressure feed passage 3 is communicated to a portion of the upstream air intake passage 21 which portion is located on the more upstream side than the gas introduction section 4 in the air movement direction and connected to this upstream air intake passage 21 via an expansion chamber 5 so as to feed the vacuum pressure inside the surge tank 2. With this ingenious arrangement of the connecting portion of connecting the vacuum pressure feed passage 3 to the upstream air intake passage 21 together with the provision of the expansion chamber 5, such inadvertent entrance of gas into the vacuum pressure feed passage 3 can be effectively restricted.

The vacuum pressure feed passage 3, as shown in FIG. 2, includes a first vacuum pressure feed passage 31 to which a vacuum pressure feed port (not shown) from the vacuum pressure actuator is connected and a second vacuum pressure feed passage 32 to which a vacuum pressure feed port from the brake booster is connected.

The expansion chamber 5, as shown in FIG. 1 and FIG. 2, consists essentially of a first expansion chamber 51 provided in the welding face 10*a* of the upper piece 1*a* and a second expansion chamber 52 provided in the welding face 10*b* of the middle piece 1*b*. The first expansion chamber 51 includes a first opening 51*a* communicated to the vacuum pressure feed passage 3 and the second expansion chamber 52 includes a second opening 52*b* communicated to the upstream air intake passage 21.

Further, similarly to the above, the first gas introduction section 41 consists essentially of a first gas introduction passage 41*a* provided in the welding face 10*a* and a second gas introduction passage 41*b* provided in the welding face 10*b*.

Incidentally, a third opening 41*c* via which the second gas introduction passage 41*b* and the upstream air intake passage 21 are communicated to each other is provided on more downstream side in the air movement direction than the second opening 52*a*. For this reason, the inadvertent entrance of the PCV gas introduced from the first gas introduction section 41 to the vacuum pressure feed passage 3 can be effectively restricted.

The second opening 52*a* has a greater opening area than the first opening 51*a* so that the vacuum pressure inside the surge tank 2 may be fed smoothly from the vacuum pressure feed passage 3 to e.g. the vacuum pressure actuator or the like. This arrangement effectively restricts occurrence of clog-up of the second opening 52*a* due to coagulation of the fuel component and water contained in the gas, so that the vacuum pressure inside the surge tank 2 can be fed appropriately from the vacuum pressure feed passage 3 when needed.

Further, as compared with the vacuum pressure feed passage 3, the expansion chamber 5 has a greater flow area for the vacuum pressure feeding. More particularly, the cross-sectional area of the expansion chamber 5 is greater than the cross-sectional area of the vacuum pressure feed passage 3. In addition, the shape of the expansion chamber 5 is such that the vacuum pressure feed passage area is progressively increased from the first opening 51*a* toward the second opening 52*a*. That is, the suction force when the vacuum pressure to be applied to the surge tank 2 is fed to the vacuum pressure actuator or the like is reduced, so that the inadvertent entrance of the fuel component and water contained in the gas to the vacuum pressure feed passage 3 may be effectively restricted.

Moreover, of the faces together constituting the expansion chamber 5, a face 53 on the downstream side in the air movement direction is inclined toward the upstream side in the air movement direction, as illustrated in FIG. 1. Therefore, when the vacuum pressure applied to the surge tank 2 is to be fed to the vacuum pressure actuator, the gas flow generated in association with this negative pressure feeding will be guided by this face 53 to be smoothly combined with the air flowing through the upstream air intake passage 21. Therefore, turbulent flow will hardly be generated inside the expansion chamber 5. As a result, the fuel component and water will hardly be drawn into the expansion chamber 5 and the clog-up of the vacuum pressure feed passage 3 may be prevented even more reliably.

Next, the shape of the second opening 52*a* will be explained with reference to FIG. 3.

The second opening 52*a* includes an edge portion 520 at its border with the upstream air intake passage 21. As shown in FIG. 3 (*a*), the second opening 52*a* is formed such that the opening size B thereof in the direction perpendicular to the air movement direction is set shorter than the opening size A thereof in the air movement direction. That is, in the shape of the second opening 52*a*, its extending direction along the air movement direction constitutes the longitudinal direction and its extending direction perpendicular to the air movement direction constitutes the width direction. When air is caused to flow through the upstream air intake passage 21, the edge portion 520 of the second opening 52*a* which is located on the upstream side in the air movement direction and which is the cause for the gas flowing noise is rendered shorter so as to reduce the amount of air which may move in a roundabout route to enter the expansion chamber 5. Therefore, the generation of vortex flow at the edge portion 520 of the second opening 52*a* which is located on the upstream side in the air movement direction will be reduced, so that the generation of gas flowing noise due to flowing air can be restricted.

Figure 3:
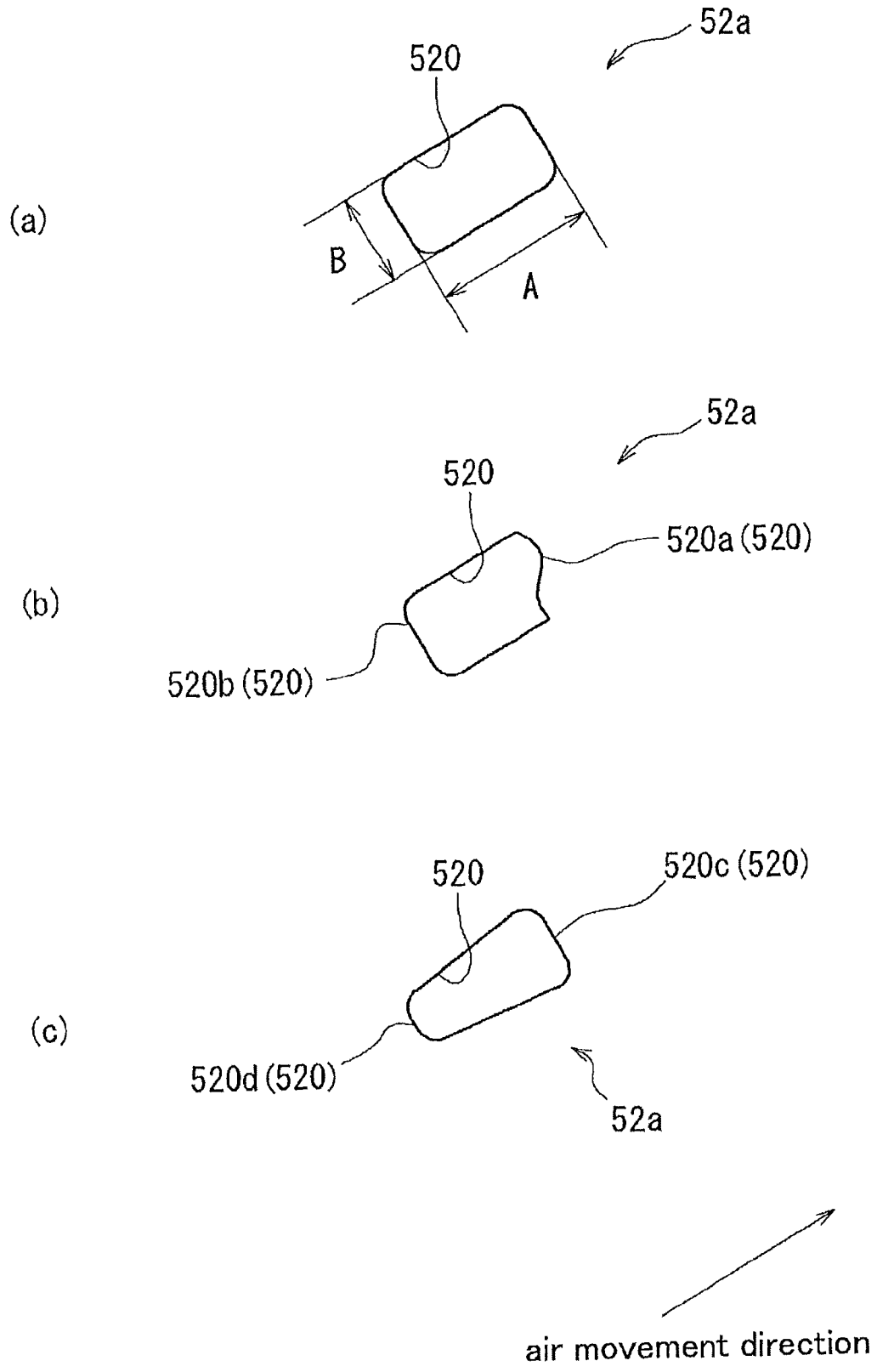
[FIG. 3] is a schematic showing the shapes of a second opening of an expansion chamber according to the embodiment.

FIGS. 3 (*b*) and (*c*) show variations of FIG. 3 (*a*). In FIG. 3 (*b*), for the edge portion 520 in the width direction of the second opening 52*a* shown in FIG. 3 (*a*), the edge portion 520*b* located on the upstream side in the air movement direction is formed shorter than the edge portion 520*a* located on the downstream side in the air movement direction. Further, the edge portion 520*a* located on the downstream side in the air movement direction extends in the direction perpendicular to the air movement direction to as to include a curve. Therefore, in comparison with the case shown in FIG. 3 (*a*), the resultant shape is such that the length of the edge portion 520*a* located on the downstream side in the air movement direction is rendered longer and includes a curve. For this reason, as the opening area for the second opening 52*a* can be secured, the length dimension of the edge portion 520*a* can be short and generation of gas flowing noise can be restricted.

Further, in FIG. 3 (*c*), for the edge portion 520 in the width direction of the second opening 52*a* shown in FIG. 3 (*a*), the edge portion 520*d* located on the upstream side in the air movement direction is formed shorter than the edge portion 520*c* located on the downstream side in the air movement direction. In comparison with the case shown in FIG. 3 (*a*), the length of the edge portion 520*d* located on the upstream side in the air movement direction is rendered shorter, hence, the opening area of the second opening 52*a* progressively decreases from the edge portion 520*c* toward the edge portion 520*d*. When the air is caused to flow in the upstream air passage 21, since the edge portion 520*d* has the shorter length as compared with FIG. 3 (*a*), the generation of air flowing noise attributable to the moving air and the edge portion 520*d* and due to the turbulent flow of air will be even more restricted.

In the above, the second opening 52*a* has a shape including a curve. But, the invention is not limited thereto. Further, the shape of the second opening 52*a* can be an oval shape.

Incidentally, when the upper piece 1*a* is to be formed, the first expansion chamber 51 and the vacuum pressure feed passage 3 will be formed integral with each other. For this reason, the position where the vacuum pressure feed passage 3 is to be communicated to the first expansion chamber 51 can be decided at the time of designing. In recent years, increasing number of components for providing various functions are mounted in a vehicle, so that the space available for mounting an intake manifold is becoming limited. In particular, depending on the orientation of the ports to be attached to the intake manifold, there arises the risk of interference with other components or of the components exceeding the size specified by the intake manifold. However, with the intake manifold 1 according to the present embodiment, it is possible to change the orientation of the vacuum pressure feed passage 3 to which the vacuum pressure feed port is connected, depending on the vehicle on which it is to be mounted. Therefore, the intake manifold 1 according to the present embodiment can be mounted on various vehicles and also the intake manifold 1 can be formed compact.

Further, in the manufacturing process, the vacuum pressure feed passage 3 to be communicated to the first expansion chamber 51 will be formed by e.g. blow molding technique. That is, when the upper piece 1*a* is to be injection-molded, the first expansion chamber 51 and the vacuum pressure feed passage 3 can be formed at the step of injecting resin. For this reason, the disposing positions, the size and the number of the vacuum pressure feed passages 3 can be decided in a small number of steps and the upper piece 1*a* can be formed with simple designing. Further, the first gas introduction section 41 is also formed integral with the first gas introduction passage 41*a* as described above and the first gas introduction section 41 is formed by e.g. the blow molding technique. And, the orientation of the first gas introduction section 41 to which the PCV gas introduction port for introducing PCV gas is connected can be changed, depending on the vehicle to which it is to be mounted.

As described above, with the intake manifold 1 relating to the instant embodiment, since the vacuum pressure feed passage 3 is disposed more upstream in the air movement direction than the gas introduction section 4, it is possible to restrict inadvertent entrance of fuel component and water contained in the gas to the vacuum pressure feed passage 3 due to the entraining flow of the surge tank 2. That is, blocking (clog-up) of the vacuum pressure feed passage 3 due to coagulation of fuel component and water can be restricted. Moreover, as the vacuum feed passage 3 feeds the vacuum pressure inside the surge tank 2 via the expansion chamber 5 to a vacuum pressure actuator or the like, the above-described effect can be enhanced.

Also, since the expansion chamber 5 is formed by welding of the welding face 10*a* and the welding face 10*b*, it can be arranged in the intake manifold 1 without using any complicated arrangement.

[Other Embodiments]

The disposing position and the number of components of the gas introduction section 4 are not limited to those disclosed in the foregoing embodiment. They can freely vary as long as they allow distributed feeding of the PCV gas or EGR gas or the like introduced from the gas introduction section 4 to the respective downstream intake passages 22.

In the foregoing embodiment, the vacuum pressure feed passage 3 is configured to be communicated to the upstream intake passage 21. However, the invention is not limited thereto. It can be communicated to the surge tank 2 as long as it is communicated on more upstream side than the gas introduction section 4. In this case, however, it will be needed to communicate the vacuum pressure feed passage 3 to such a portion of the surge tank 2 where the air flows in the one direction from the upstream side to the downstream side.

The intake manifold 1 relating to the foregoing embodiment consists of the three pieces 1*a*, 1*b* and 1*c*. However, the invention is not limited thereto. For instance, the intake manifold 1 can be comprised of fewer than two or more than four pieces.

The vacuum pressure feed passage 3 and the expansion chamber 5 relating to the foregoing embodiment are formed integral with the intake manifold 1. However, the invention is not limited thereto. For instance, the vacuum pressure feed passage 3 and the expansion chamber 5 are formed separately from the intake manifold 1.

The vacuum pressure feed passage 3 relating to the foregoing embodiment includes the vacuum pressure feed passages 31, 32 for feeding negative pressure to the vacuum pressure actuator and the brake booster. Instead, it will suffice for the vacuum pressure feed passage 3 to include at least one vacuum pressure feed passage.

Industrial Applicability

The present invention is applicable to an intake manifold having a surge tank connected to an air intake passage for air to be supplied to an internal combustion engine.

REFERENCE SIGNS LIST

1 intake manifold
1*a* upper piece (first piece)
1*b* middle piece (second piece)
2 surge tank
21 upstream intake passage (intake passage)
3 vacuum pressure feed passage (negative pressure feed passage)
4 gas introduction section
5 expansion chamber
51*a* first opening
52*a* second opening
520, 520*a*, 520*b*, 520*c*, 520*c*, 520*d* edge portions
53 face on the downstream side in air movement direction

The invention claimed is:

1. An intake manifold having a surge tank connected to an air intake passage for air to be supplied to an internal combustion engine, the intake manifold comprising:

a gas introduction section communicated to the air intake passage or the surge tank for introducing gas containing fuel component to the surge tank; and a negative pressure feed passage communicated to a portion of the air intake passage or the surge tank which portion is upstream of the gas introduction section in the movement direction of the air and configured to feed a negative pressure inside the surge tank to an outside;

wherein the negative pressure feed passage is connected to the air intake passage or the surge tank via an expansion chamber having a larger cross-sectional area than the cross-sectional area of the negative pressure feed passage;

wherein the expansion chamber includes a first opening communicated to the negative pressure feed passage and a second opening communicated to at least one of the air intake passage and the surge tank; and wherein the second opening is provided with an opening area greater than that of the first opening.

2. The intake manifold according to claim 1, wherein the expansion chamber includes a first piece having the first opening and formed integral with the negative pressure feed passage and a second piece having the second opening.

3. The intake manifold according to claim 1, wherein in the second opening, its opening size in the direction perpendicular to the air movement direction is set shorter than the opening size in the direction along the air movement direction.

4. The intake manifold according to claim, wherein the second opening has a shape whose longitudinal direction is the direction of its extension in the air movement direction and whose width direction is the direction of its extension in the direction perpendicular to the air movement direction; and the length of the edge portion of the second opening in the width direction is shorter on the upstream side in the air movement direction than on the downstream side in the air movement direction.

5. The intake manifold according to claim 1, wherein the expansion chamber includes a face on the downstream side in the air movement direction inclined toward the upstream side in the air movement direction.

* * * * *